United States Patent [19]

Okauchi et al.

[11] Patent Number: 5,071,740

[45] Date of Patent: Dec. 10, 1991

[54] HEAT DEVELOPABLE COLOR PHOTOSENSITIVE MATERIAL

[75] Inventors: Ken Okauchi, Hachioji; Toyoaki Masukawa, Tokyo, both of Japan

[73] Assignee: Konishiroku Photo Industry Co., Ltd., Tokyo, Japan

[21] Appl. No.: 541,041

[22] Filed: Jun. 20, 1990

Related U.S. Application Data

[63] Continuation of Ser. No. 300,255, Jan. 19, 1989, abandoned, which is a continuation of Ser. No. 42,517, Apr. 27, 1987, abandoned, which is a continuation of Ser. No. 842,261, Jan. 30, 1986, abandoned.

[30] Foreign Application Priority Data

Jan. 31, 1985 [JP] Japan ..... 60-17601

[51] Int. Cl.[5] ..... G03C 8/00

[52] U.S. Cl. ..... 430/617; 430/203; 430/214; 430/215; 430/218; 430/220; 430/619; 430/620

[58] Field of Search ..... 430/203, 214, 215, 218, 430/220, 617, 619, 620

[56] References Cited

U.S. PATENT DOCUMENTS

| | | | |
|---|---|---|---|
| 3,635,719 | 1/1972 | Ohkubo et al. | 96/114.1 |
| 4,052,214 | 10/1977 | Oishi et al. | 430/214 |
| 4,060,417 | 11/1977 | Cieciuch et al. | 430/214 |
| 4,272,594 | 6/1981 | George et al. | 430/220 |
| 4,283,477 | 8/1981 | Fletcher et al. | 430/620 |
| 4,347,301 | 8/1982 | Kliem | 430/215 |
| 4,458,002 | 7/1984 | Janssens et al. | 430/220 |
| 4,460,681 | 7/1984 | Frenchie | 430/502 |
| 4,474,867 | 10/1984 | Naito et al. | 430/203 |
| 4,503,139 | 3/1985 | Bartels-Keith et al. | 430/219 |
| 4,514,493 | 4/1985 | Hirai et al. | 430/617 |
| 4,542,594 | 9/1985 | Toya et al. | 430/214 |
| 4,584,267 | 4/1986 | Masukawa et al. | 430/620 |

FOREIGN PATENT DOCUMENTS

| | | |
|---|---|---|
| 0120403 | 3/1984 | European Pat. Off. . |
| 0119102 | 9/1984 | European Pat. Off. . |
| 0180224 | 10/1985 | European Pat. Off. . |
| 59-4694 | 1/1984 | Japan . |
| 59-180550 | 10/1984 | Japan . |
| 8100920 | 4/1981 | World Int. Prop. O. . |

OTHER PUBLICATIONS

European Patent Application 0120403, Oct. 3, 1984, abstract, pp. 9, 15, 16.

European Patent Application 0180224, May 7, 1986, abstract.

Research Disclosure No. 17029, Jun. 1978.

Encyclopedia of Polymer Science and Engineering, vol. 8, John Wiley & Sons, Inc., 1987, p. 647.

Kuwahara, T., "Pigment" Osaka Industrial Research Institute, Ministry Trade and Industry, 1948, p. 35.

Catalog of Zinc Oxide, Hakusui Chemical Industries, Limited, p. 1.

*Primary Examiner*—Charles L. Bowers, Jr.
*Assistant Examiner*—Janet C. Baxter
*Attorney, Agent, or Firm*—Finnegan, Henderson, Farabow, Garrett, and Dunner

[57] ABSTRACT

A heat developable color photosensitive material capable of forming color images in a heat development, more particularly, capable of obtaining heat developable color diffusion transfer images substantially high in a maximum density. The heat developable color photosensitive material contains at least two photosensitive layers which are different from each other in color sensitivity and a non-photosensitive interlayer containing particles interposed between the photosensitive layers.

6 Claims, No Drawings

HEAT DEVELOPABLE COLOR PHOTOSENSITIVE MATERIAL

This application is a continuation of application Ser. No. 07/300255, filed Jan. 19, 1989, abandoned which was a continuation of 07/042,517, filed Apr. 27, 1987, abandoned which was a continuation of 06/842,261, filed Jan. 30, 1986, abandoned.

BACKGROUND OF THE INVENTION

This invention relates to a heat developable color photosensitive material capable of forming color images in a heat development and more particularly to a heat developable color photosensitive material capable of obtaining heat developable color diffusion transfer images substantially high in a maximum density.

Photographic methods using the conventional known photosensitive silver halides are superior to the other photographic methods in gradation, image lasting quality and the like, and they have most popularly been put into practice.

In these methods, however, there have been many problems such as that it takes time and labor to process and there is some fear for inflicting an injury upon a person with processing chemicals or a contamination upon a worker and a processing room with the chemicals and further a measure against environmental pollution is to be taken for waste liquids. It has, therefore, been expected to develop such a photosensitive material as is capable of using a photosensitive silver halide and being processed in a dry process.

There have been many proposals for the abovementioned dry process photographic systems. Among them, a heat developable photosensitive material of which developing step can be carried out in a heat process is attracting attention as a photosensitive material capable of answering the abovementioned expectation.

Such heat developable photosensitive materials are described in, for example. Japanese Patent Examined Publication No. 4921/1968 and 4924/1968, wherein the photosensitive materials each comprising an organic silver salt, a silver halide and a reducing agent are disclosed.

Further, some attempts have been tried for improving the abovementioned heat developable photosensitive materials to obtain color images in a variety of processes.

In U.S. Pat. Nos. 3,531,286, 3,761,270, 3,764,328 and the like, for example, there disclose the heat developable color photosensitive materials capable of forming color images in a reaction of the oxidation products of an aromatic primary amine developing agent with couplers.

In Research Disclosure Nos. 15108 and 15127, there disclose the heat developable color photosensitive materials each capable of forming color images in a reaction of the oxidation products of the developing agent comprising a sulfonamidophenol or sulfonamidoaniline derivative with couplers. In the abovementioned processes, however, there is such a problem that color images obtained become turbid. because a reduced silver image and a color image are produced at the same time in an exposed area, after a heat development is completed. To solve the abovementioned problem, there is such a method in which a silver image is removed in a liquid process, or dyes only are transferred to another layer such as an image receiving sheet having an image receiving layer. However, the methods still have such a problem that it is not so easy to distinguish the dyes from unreactants so that the dyes only may be transferred to another layer.

Research Disclosure No. 16966 discloses a heat developable color photosensitive material capable of forming color images in such a manner that an organic imino silver salt having a dye portion is used and the imino groups are set free in exposed areas in a heat development so that a color image may be formed with a solvent on an image receiving layer that serves as a image transfer paper. However, this method still has problems that it is hard to inhibit the dyes in unexposed areas from being set free and a sharp and clear color image may not therefore be obtained.

In Japanese Patent Publication Open to Public Inspection (hereinafter called Japanese Patent O.P.I. Publication) Nos. 105821/1977, 105822/1977 and 50328/1981, U.S. Pat. No. 4,235,957, Research Disclosure Nos. 14448, 15227 and 18137, and the like, there disclose the heat developable color photosensitive materials each capable of forming positive color images in a heat sensitive silver dye bleaching process. In the abovementioned process, however, there are problems that extra processes and photographic component materials are required for superposing sheets each containing an activating agent for accelerating the bleach of dyes, and color images obtained are gradually reduced and bleached with co-existing freed silver or the like, in a long preservation of the images.

U.S. Pat. Nos. 3,180,732, 3,985,565, and 4,022,617, and Research Disclosure No. 12533 each disclose heat developable color photosensitive materials capable of forming color images in utilizing leuco dyes. In the abovementioned processes. however, there are the problems that it is difficult to contain the leuco dyes stably in a photographic photosensitive material and the photosensitive material is gradually colored in preservation.

Japanese Patent O.P.I. Publication No. 179840/1982 discloses a heat developable color photosensitive material capable of forming color images in using a dye releasing assistant and a reducible dye-providing substance capable of releasing a diffusible dye.

Japanese Patent O.P.I. Publication Nos. 186744/1982, 123533/1983, 149046/1983 and 149047/1983, and Japanese Patent Application No. 109293/1983 each disclose heat developable color photosensitive materials each capable of obtaining transferred color images in releasing or forming diffusible dyes through a heat development. The heat developable color photosensitive materials such as those disclosed in the abovementioned patent specifications have such a disadvantage that a maximum density (Dmax) of a transferred image is relatively lower, or a fog (Dmin) thereof is relatively greater.

There have recently been some techniques proposed especially for increasing a maximum density. Namely. Japanese Patent O.P.I. Publication Nos. 57231/1984, 74547/1984, 84236/1984, 180554/1984 and 177550/1984, for example, disclose a variety of matters to serve as a development accelerator.

And, Japanese Patent O.P.I. Publication No. 178457/1984 discloses an aliphatic amide or a formylamide to be used in a method of accelerating the rate of forming a dye image. Every one of the disclosed techniques has the disadvantage that they are still insufficient to obtain a high maximum density or a fog is substantially increased.

Japanese Patent Application 104249/1983 describes a technique that the transferability of dyes may be improved by using a binder, such as gelatin and polyvinyl pyrrolidone, which contains a heat solvent.

Japanese Patent Application No. 169321/1983 describes a technique of improving a heat development and a dye transferability in using gelatin and polyvinyl alcohol to serve as a binder.

Japanese Patent Application No. 223274/1983 describes a multilayer type heat developable color diffusion transfer photosensitive material which is improved in the dye transferability by interposing between two photosensitive layers an interlayer containing a binder containing gelatin and the derivatives thereof in an amount of less than 50% by weight.

Even in the abovementioned techniques, any fully satisfactory dye transferability cannot be obtained. There are, accordingly, demands for the developments of a heat developable color photosensitive material capable of displaying an excellent dye transferability and a high image density.

SUMMARY OF THE INVENTION

Object of the Invention

This invention takes the abovementioned circumstances heretofore having been existing into consideration. It is, accordingly, an object of the invention to provide a heat developable color photosensitive material not involving the increase of a minimum density, i.e., a fogginess, and being capable of obtaining images each having a satisfactorily high maximum density.

The abovementioned object of the invention can be achieved with a heat developable color photosensitive material containing at least a photosensitive silver halide, a dye providing substance capable of releasing or forming a diffusible dye through a heat development, a reducing agent and a binder, and comprising a support bearing thereon at least two photosensitive layers different from each other in color sensitivity of the abovementioned photosensitive silver halide, wherein an interlayer containing particles which are in a solidified state at a temperature for a heat developing process is interposed between the abovementioned two photosensitive layers.

DETAILED DESCRIPTION OF THE INVENTION

A heat developable color photosensitive material of the invention bears thereon at least two photosensitive layers which are different from each other in color sensitivity, and more preferably, three photosensitive layers which are different from each other in color sensitivity. The abovementioned photosensitive layers and such a non-photosensitive layer as an interlayer and a protective layer are coated on the support thereof. It is allowed to provide the layers in any order, however, a popular layer arrangement is that a red-sensitive layer capable of providing cyan dyes, a first interlayer, a green-sensitive layer capable of providing magenta dyes, a second interlayer, a blue-sensitive layer capable of providing yellow dyes, and a protective layer may be coated in order from the support side. In another layer arrangement, it is allowed to coat a blue-sensitive layer capable of providing yellow dyes, a first interlayer, a green-sensitive layer capable of providing magenta dyes, a second interlayer, a red-sensitive layer capable of providing cyan dyes, and a protective layer, in order from the support side. Besides the abovementioned layers, it is further allowed, if occasion demands, to provide an image receiving layer for receiving dyes produced in a heat development, and a white pigment layer for making a dye image formed on the image receiving layer visible in the form of a reflected image.

An interlayer relating to the invention is to be interposed between two photosensitive layers which are different from each other in the color sensitivity of photosensitive silver halide. Binders to be contained in the interlayers include, for example, gelatin or the derivatives thereof; a cellulose derivative; a polysaccharide such as dextran; a natural material such as gum arabic and the like; a water-soluble polymer such as polyvinyl acetal and preferably polyvinyl butyral having an acetalation degree of not more than 20%, a polyacrylamide, a polyvinyl pyrrolidone, an ethyl cellulose, a polyvinyl alcohol preferably having a saponification rate of not less than 75%. It is also allowed to use a mixture of two or more kinds of the abovementioned binders.

The interlayers each relating to the invention may be formed on a photosensitive layer by a coating means, for example. Such a coating means as is to be adopted includes. for example, a variety of coating methods such as an impregnation coating method, an air-knife coating method, a curtain coating method, the hopper coating method described in U.S. Pat. No. 3,681,294, and the like. The interlayers formed by the abovementioned coating means are to be 0.01 μm to 20 μm and more preferably 0.1 μm to 10 μm in dried thickness.

The interlayers each relating to the invention are also allowed to be added with various additives besides the abovementioned binders. Such additives include, for example, a nonaqueous polar solvent having a —CO—, —$SO_2$— or —SO— group described in U.S. Pat. No. 3,667,959, the melt former described in U.S. Pat. No. 3,438,776, a polyalkylene glycol described in U.S. Pat. No. 3,666,477 and Japanese Patent O.P.I. Publication No. 19525/1976, and the like.

Particles contained in the interlayers relating to the invention (hereinafter called solid particles) are in a solidified state at a temperature for a heat developing process. Such particles as are usable for this purpose include, for example, those of various white pigments such as titanium dioxide, zinc oxide, calcium oxide, calcium carbonate, magnesium carbonate, barium sulfate, ammonium oxide, silicon dioxide, and the like; those of black pigments such as carbon black; those of organic or inorganic colored pigments; and the like. Besides the above, metal powders such as ferrite powders, aluminium powders, copper powders, graphite powders and the like may be used.

In addition thereto, particles of a polymer having a softening point of not lower than 150° C. are also useful for the solid particles to be used in the invention Such polymer particles include, for example, those of a urea-formalin resin, styrene-methacrylic acid copolymer, a polystyrene resin, and the like. The particularly preferable solid particles include, for example, those of titanium dioxide or carbon black.

If occasion demands, two or more kinds of the abovementioned solid particles may jointly be contained in the interlayers relating to the invention.

An average particle size of the solid particles of the invention is from 0.01μ to 1.0μ and more preferably from 0.1μ to 0.5μ. A content of the solid particles of the invention is preferably not less than 5% by weight to a binder content in an interlayer of the invention and, more preferably, from 20 to 100% by weight thereto.

The solid particles of the invention may be contained in a photosensitive layer, a subbing layer, a protective layer, or the like.

The dye providing substances each capable of being used in the invention will now be described below:

Such dye providing substances are allowed to use, provided that they may be able to take part in a reduction reaction of a photosensitive silver halide and/or an organic silver salt which may be used if occasion demands and to form or release diffusible dyes by serving as a function of the reaction. Such dye providing substances are classified, according to their reaction mechanisms, into both of a negative type dye providing substance capable of acting on a positive function, i.e., thereby a negative dye image is formed when using a negative type silver halide, and a positive type dye providing substance capable of acting on a negative function, i.e., thereby a positive dye image is formed when using a negative type silver halide. The abovementioned negative type dye providing substances ar further classified into as follows:

- Negative type dye providing substances:
  - Compounds which release diffusible dyes when oxidized.
    - Reducible dye releasing compounds.
  - Compounds which form diffusible dyes when coupling to a reducing agent.
    - Coupling dye releasing type compounds.
    - Coupling dye forming type compounds.

Each of the dye providing substances will further be described below:

The reducible dye releasing compounds include, for example, the compounds represented by the following Formula (1):

$$\text{Car-NHSO}_2\text{-Dye} \qquad \text{Formula (1)}$$

wherein, Car represents a reducible substrate, that is, the so-called carrier, which is oxidized to release dyes when a photosensitive silver halide and/or an organic silver salt is used; and Dye represents a diffusible dye residual group.

The typical examples of the abovementioned reducible dye releasing compounds are described in Japanese Patent O.P.I. Publication Nos. 179840/1982, 116537/1983, 60434/1984, 65839/1984, 71046/1984, 87450/1984, 88730/1984, 123837/1984, 165054/1984, and 165055/1984; and the like. The following compounds may be given as the examples thereof:

<1>

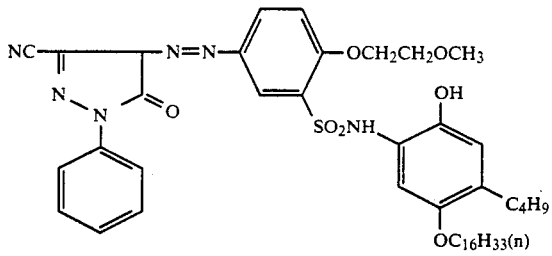

<2>

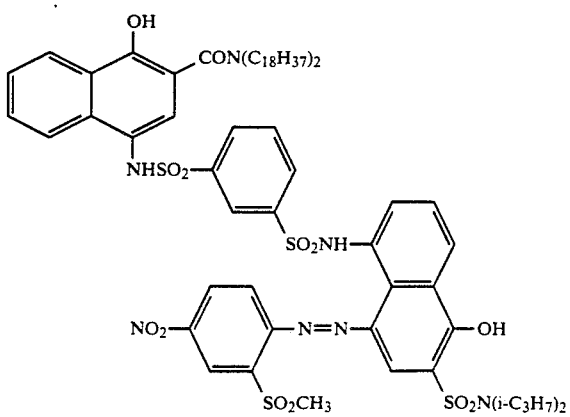

-continued

<3>

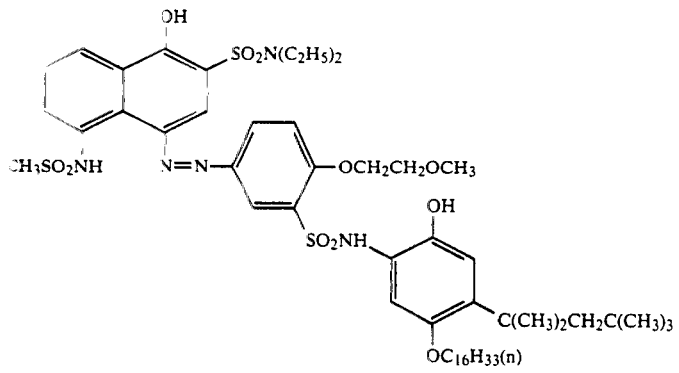

There are another type of the reducible dye releasing compounds including, for example, the compound represented by the following formula (2):

Formula (2):

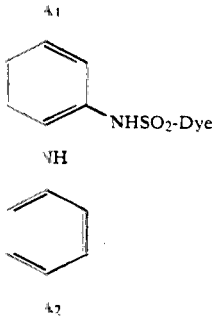

wherein, $A_1$ and $A_2$ each represent hydroxy group or an amino group; and Dye is synonymous with Dye denoted in the abovementioned Formula (1), The typical examples of the compounds are described in Japanese Patent O.P.I. Publication No. 124329/1984.

The coupling dye releasing type compounds include, for example, the compounds represented by the following formula (3).

$Cp_1 \leftarrow J \rightarrow_n Dye$ wherein, $Cp_1$ represents an organic group (i.e., the so-called coupler residual group) capable of releasing diffusible dyes through a reaction thereof on the oxidation products of a reducing agent; J represents a divalent linking group that cleaves the link of $Cp_1$ to J through a reaction thereof on the oxidation product of a reducing agent; n is an integer of 0 or 1; and Dye is synonymous with that defined in the abovementioned Formula (1). The abovementioned $Cp_1$ is preferred to be substituted by various kinds of ballast groups so that it makes a coupling dye releasing type compound nondiffusible. Such ballast groups include, for example, an organic group having not less than 8 carbon atoms and more preferably not less than 12 carbon atoms; a hydrophilic group such as a sulfo group, a carboxy group and the like; or a group having not less than 8 carbon atoms and more preferably not less than 12 carbon atoms and such a hydrophilic group as a sulfo group, a carboxy group or the like together. Besides the above, a polymer chain may be given as one of the particularly preferable examples of the ballast groups.

The typical examples of the compounds represented by the abovementioned Formula (3) are described in Japanese Patent O.P.I. Publication Nos. 186744/1982, 122596/1982, 160698/1982, 174834/1984, 224883/1982, and 159159/1984, and Japanese Patent Application No. 104901/1984, respectively. The following compounds may be given as the examples thereof:

<4>

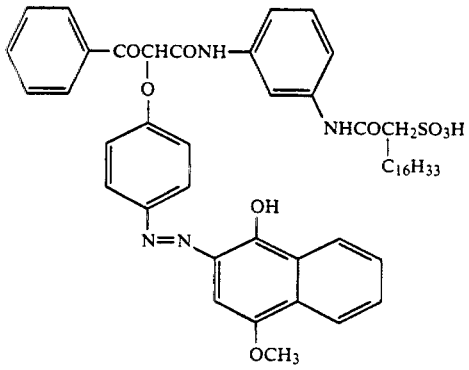

-continued

<5>

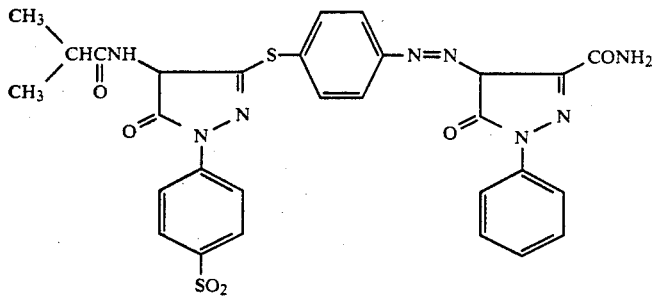

The coupling dye forming compounds include, for example, the compounds represented by the following Formula (4):

$$Cp_2\text{-}(X)\text{-}(Q) \qquad \text{Formula (4)}$$

wherein, $C_{p2}$ represents an organic group capable of forming diffusible dyes through a (coupling) reaction thereof on the oxidation product of a reducing agent, that is, the so-called coupler residual group; X represents a divalent linking group; and Q represents a ballast group.

The coupler residual groups represented by $Cp_2$ are preferably not more than 700 in molecular weight and more preferably not more than 500 therein, because of the diffusibility of the dyes to be produced.

Further, it is preferred that the ballast groups are the same as those defined in the abovementioned Formula (3), and particularly they are such a group as is having not less than 8 and more preferably 12 carbon atoms and a hydrophilic group such as a sulfo group, a carboxy group or the like together, and, still further preferably they are a polymer chain.

The coupling dye forming compounds each having the abovementioned polymer chain include, preferably, a polymer having a repetition unit derived from a monomer represented by the following Formula (5):

$$Cp_2\text{-}(X)\text{-}(Y)_l\text{-}(Z)\text{-}(L) \qquad \text{Formula (5)}$$

wherein, $Cp_2$ and X each are synonymous with those defined in the abovementioned Formula (4); Y represents an alkylene group, an arylene group or an aralkylene group; Z represents a divalent organic group; and L represents an ethylene unsaturated group or a group having an ethylene unsaturated group, and l represents 0 or 1.

The typical examples of the coupling dye forming compounds represented by the abovementioned Formulas (4) and (5) are given in the descriptions of Japanese Patent O.P.I. Publication Nos. 124339/1984 and 181345/1984: and Japanese Patent Application Nos. 109293/1983, 179657/1984, 181604/1984, 182506/1984 and 182507/1984. The following compounds are given as the examples thereof:

<6>

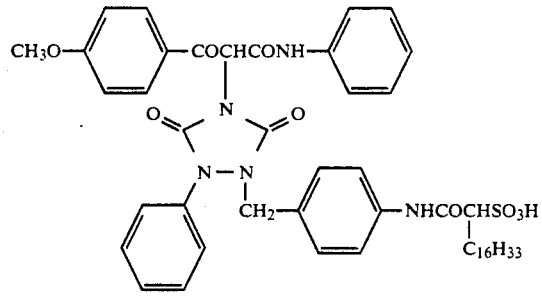

<7>

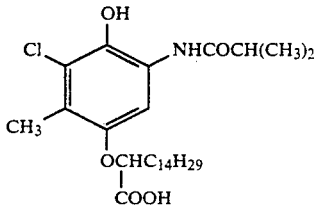

-continued
<8>
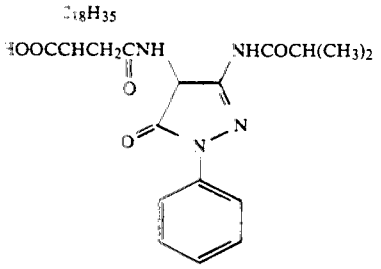
Polymer
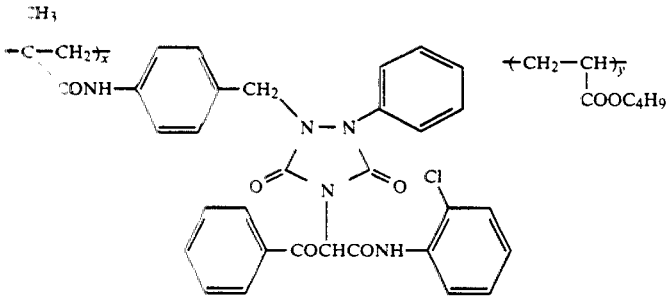
x: 60% by weight
y: 40% by weight
<9>
<10>
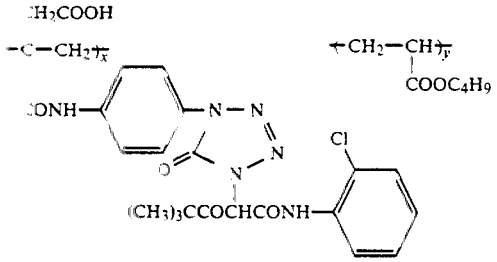
x: 50% by weight
y: 50% by weight
<11>
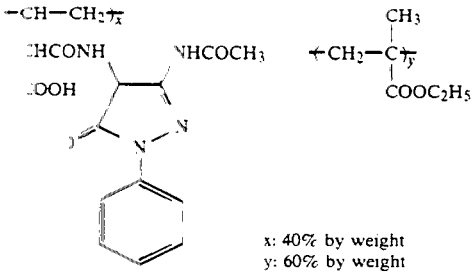
x: 40% by weight
y: 60% by weight
<12>
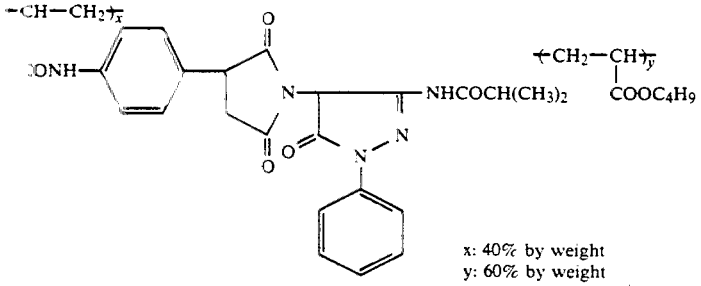
x: 40% by weight
y: 60% by weight -continued

<13>

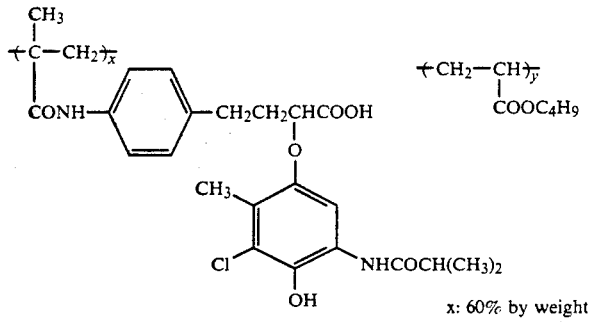

x: 60% by weight
y: 40% by weight

<14>

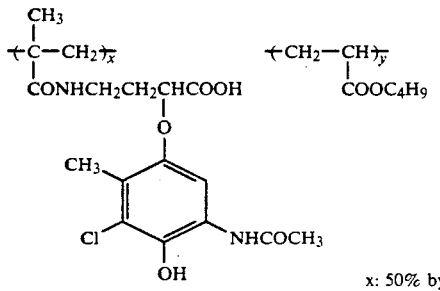

x: 50% by weight
y: 50% by weight

To be more in detail, it is preferred that the coupler residual groups denoted by $Cp_1$ or $Cp_2$ in the above-given Formulas (3), (4) and (5) are the groups represented by the following formulas:

Formula (6)

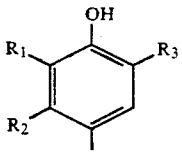

Formula (7)

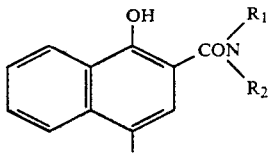

Formula (8)

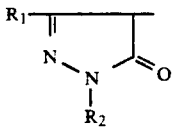

Formula (9)

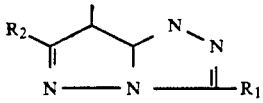

Formula (10)

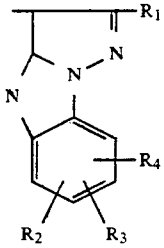

-continued

Formula (11)

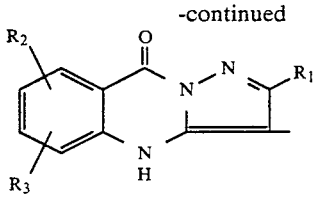

Formula (12)

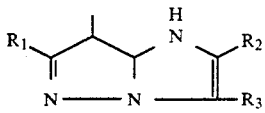

Formula (13)

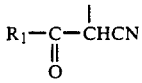

Formula (14)

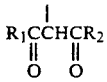

Formula (15)

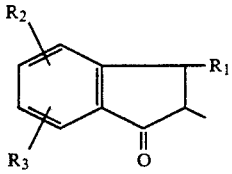

wherein, $R_1$, $R_2$, $R_3$, and $R_4$ represent hydrogen. a halogen, an alkyl group, a cycloalkyl group, an aryl group, an acyl group, an alkyloxycarbonyl group, an aryloxycarbonyl group, an alkylsulfonyl group, an arylsulfonyl group, a carbamoyl group, a sulfamoyl group, an acyloxy group, an amino group, an alkoxy group, an aryloxy group, a cyano group, a ureido group, an alkylthio group, an arylthio group, a carboxy group, a sulfo group or a heterocyclic residual group, respectively; and they may further be substituted by a hydroxyl group, a carboxy group, a sulfo group, an alkoxy group, a cyano group, a nitro group, an alkyl group, an aryl group, an aryloxy group, an acyloxy group, an acyl group, a sulfamoyl group, a carbamoyl group, an imido group, a halogen or the like.

The abovementioned substituents may be selected in accordance with the purposes of $Cp_1$ and $Cp_2$. In the case of $Cp_1$, it is preferred that one of the substituents is a ballast group, as aforementioned, and in the case of $Cp_2$, it is preferred that a substituent may be so selected that the molecular weight thereof may be not more than 700 and more preferably not more than 500 for increasing the diffusibility of dyes to be produced.

The positive type dye providing substances include, for example, the oxidative dye releasing compounds represented by the following Formula (16):

Formula (16):

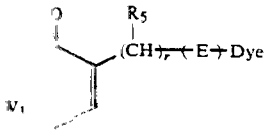

wherein, $W_1$ represents a group of atoms necessary for forming a quinone ring which is allowed to have a substituent thereon; $R_5$ represents an alkyl group or hydrogen; E represents

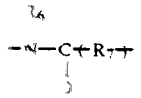

(wherein $R_6$ represents an alkyl group or hydrogen and $R_7$ represents oxygen or

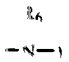

or $—SO_2—$; r is an integer of 0 or 1; and Dye is synonymous with that defined in the abovementioned Formula (1). The typical examples of the abovementioned compounds are described in Japanese Patent O.P.I. Publication Nos. 166954/1984, 154445/1984 and the like. They include, for example, the following compounds:

<15>

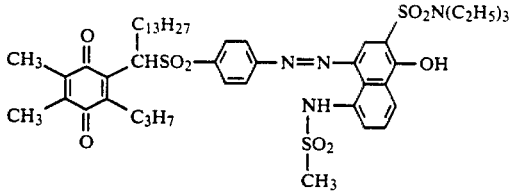

<16>

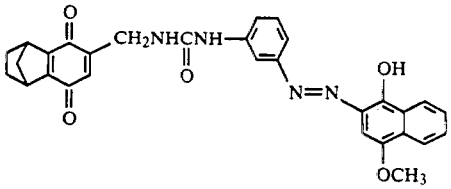

Another positive type dye providing substances include, for example, a compound of which dye releasing capability is lost when it is oxidized. Such compounds are typified by the compounds represented by the following Formula (17):

Formula (17):

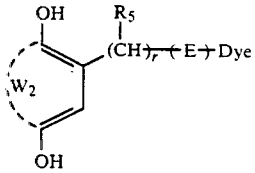

wherein, $W_2$ represents a group of atoms necessary for forming a benzene ring which is allowed to have a substituent thereon; and, $R_5$, E and Dye each are synonymous with those defined in the abovementioned Formula (16). The typical examples of these compounds are described in Japanese Patent O.P.I. Publication Nos. 124329/1984 and 154445/1984, and they include, for example, the following compounds:

<17>

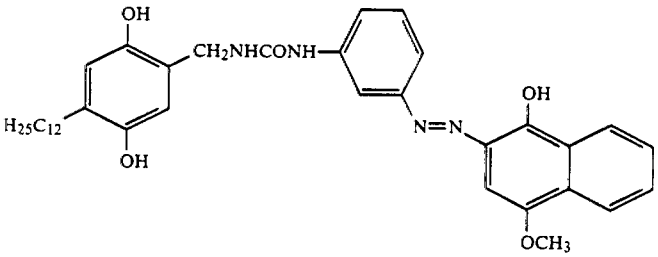

<18>

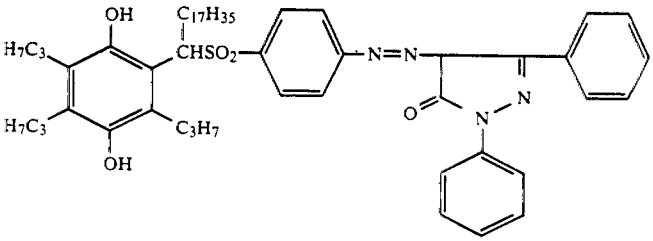

A further positive type dye providing substances includes, for example, the compounds represented by the following Formula (18):

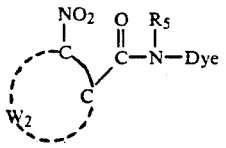

Formula (18):

wherein, $W_2$, $R_5$ and Dye each are synonymous with those defined in the abovementioned Formula (17). The typical examples of the compounds are described in Japanese Patent O.P.I. Publication No. 154445/1984 and the like, and they include, for example, the following compounds:

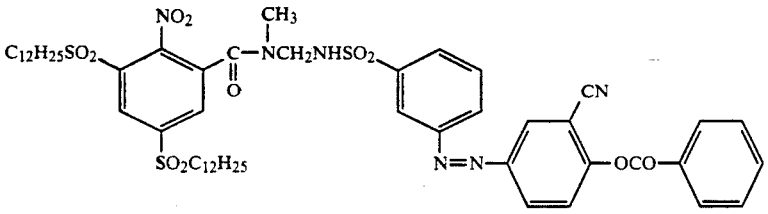

<19>

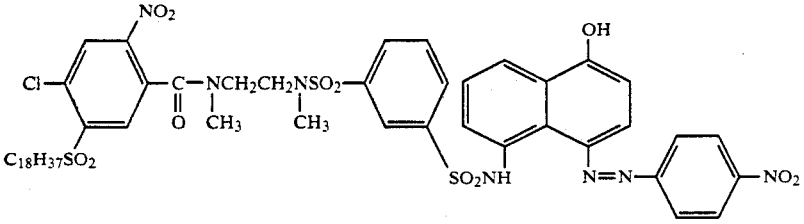

<20>

A further detailed description will now be made about the diffusible dye residual groups each denoted by Dye in the abovementioned Formulas (1), (2), (3), (16), (17) and (18).

The residual groups of the diffusible dyes are to be not more than 800 and more preferably not more than 600 in molecular weight, and they include, for example, the residual groups of azo dyes, azomethin dyes, anthraquinone dyes, naphthoquinone dyes, styryl dyes, nitro dyes, quinoline dyes, carbonyl dyes, phthalocyanine dyes and the like. These dye residual groups are also allowed to be in the form of the temporary blue sensitized groups which are capable of color recurring when they are heat developed or transferred. On the other hand, such a chelatable dye residual group as described in Japanese Patent O.P.I. Publication Nos. 48765/1984 and 124337/1984, for example, is a desirable one of the abovementioned dye residual groups, for the purpose of increasing a light-fastness of images.

The abovementioned dye providing substances are allowed to use independently and in combination either. An amount used thereof is not limitative but may be determined in accordance with the kinds of the dye providing substances, an independent or combined use thereof, and the like. They may be used in an amount of from 0.005 g to 50 g per sq. meter and preferably from 0.1 g to 10 g per sq. meter, for example.

Any process may be taken to contain the dye providing substances used in the invention into the photosensitive layers of a heat developable color photosensitive material.

For example, the dye providing substance used in the invention is dissolved in a low boiling solvent such as methanol, ethanol, ethyl acetate or the like, or a high boiling solvent such as dibutyl phthalate, dioctyl phthalate, tricresyl phosphate or the like and is then ultrasonically homogenized to use; or the dye providing substance of the invention is dissolved in an aqueous alkali solution such as those of a 10% sodium hydroxide or the like and is then neutralized to use, or the dye providing substance of the invention and an aqueous solution of an appropriate polymer such as those of gelatin, polyvinyl butyral, polyvinyl pyrrolidone or the like are homogenized together by means of a ball-mill and are then used.

The heat developable color photosensitive materials each contain a photosensitive silver halide as well as the abovementioned dye providing substances.

Such a photosensitive silver halide include, for example, silver chloride, silver bromide, silver iodide, silver chlorobromide, silver chloroiodide, silver iodobromide, silver chloroiodobromide and the like. Such a photosensitive silver halide as mentioned above may be prepared in any processes such as a single-jet process, a double-jet process or the like each used in the photographic technical field. In this invention, however, it will come out a desired effect to prepare a photosensitive silver halide emulsion containing a photosensitive silver halide, in a process of preparing an ordinary silver halide emulsion.

The photosensitive silver halide emulsions may also be chemically sensitized in any process used in the photographic field. Such sensitizing processes include a variety of the processes such as a gold-sensitization process, a sulfur sensitizing process, a gold-sulfur sensitizing process, a reduction sensitizing process, and the like.

The silver halide being contained in the abovementioned photosensitive emulsions may be of either of the coarse particles and the fine particles. A preferable particle size thereof is from about 0.001 μm to about 1.5 μm in diameter, and more preferably from about 0.01 μm to about 0.5 μm therein.

The photosensitive silver halide emulsions prepared as mentioned above may most preferably be applied to the heat developable photosensitive layers which are the component layers of the photosensitive materials of the invention.

In the invention, another process of preparing a photosensitive silver halide may also be applied to form the photosensitive silver halide in a portion of an organic silver salt by making a photosensitive silver salt forming component present together with an organic silver salt of which will be described later. The photosensitive silver salt forming components to be used in the abovementioned preparation processes include the following matters:

An inorganic halide such as a halide represented by MXn in which M represents hydrogen, $NH_4$ group or a metal atom; X represents Cl, Br or I; and, when M is hydrogen or $NH_4$ group, n is I, and when M is a metal atom, n is the valency thereof; and such metal atoms include, for example, lithium, sodium, potassium, rubidium, cesium, copper, gold, beryllium, magnesium, calcium, strontium, barium, zinc, cadmium, mercury, aluminium, indium, lanthanum, ruthenium, thallium, germanium, tin, lead, antimony, bismuth, chromium, molybdenum, tungsten, manganese, rhenium, iron, cobalt, nickel, rhodium, palladium, osmium, iridium, platinum, cerium, and the like;

A metallic complex including, for example, $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_3RhCl_6$, $(NH_4)_3RhBr_6$, and the like;

An onium halide including, for example, a quaternary ammonium halide such as tetramethylammonium bromide, trimethylphenylammonium bromide, cetylethyldimethylammonium bromide, 3-methylthiazolium bromide, and trimethylbenzylammonium bromide; a quaternary phosphonium halide such as tetraethylphosphonium bromide; a tertiary sulfonium halide such as benzylethylmethylsulfonium bromide and 1-ethylthiazolium bromide; and the like;

A hydrocarbon halide including, for example, iodoform, bromoform, carbon tetrabromide, 2-bromo-2-methylpropane, and the like;

An N-halide including, for example, N-chlorosuccinimide, cetamide, N-iodosuccinimide, N-bromophthalazinone, N-chlorophthalazinone, N-bromoacetanilide, N,N-dibromobenzene sulfonamide, N-bromo-N-methylbenzene sulfonamide, 1,3-dibromo-4,4-dimethyl hydantoin, and the like;

Other halogen-containing compounds including, for example, triphenylmethyl chloride, triphenylmethyl bromide, 2-bromobutyric acid, 2-bromoethanol, and the like; and the like matters.

The abovementioned photosensitive silver halide and photosensitive silver salt forming components may be used in combination in a variety of processes, and they are preferably used in an amount of from 0.001 g to 50 g and more preferably from 0.1 g to 10 g per sq. meter of every one of the layers.

The heat developable color photosensitive materials of the invention are also allowed to comprise the layers which are respectively photosensitive to blue light, green light and red light in a multilayered arrangement, namely, a heat developable blue light sensitive layer, a heat developable green light sensitive layer and a heat developable red light sensitive layer. In addition, no less than two of the same color light sensitive layers such as the high speed layer thereof and the low speed layer thereof may also be provided separately.

In the abovementioned case, each of a blue light sensitive silver halide emulsion, a green light sensitive silver halide emulsion and a red light sensitive silver halide emulsion may be prepared respectively by adding various kinds of spectral sensitization dyes to the abovementioned silver halide emulsions.

The typical spectral sensitization dyes capable of being used include, for example, a cyanine, a merocyanine, a 3- or 4-nuclei complex cyanine, a holopolar cyanine, styryl, a hemicyanine, an oxonol and the like. Among the cyanine dyes, the more preferable ones are those having a basic nucleus, such as thiazoline, oxazoline, pyrroline, pyridine, oxazole, thiazole, selenazole, imidazole and the like. Such a nucleus as mentioned above may also have an enamine group which is capable of producing an alkyl group, an alkylene group, a hydroxyalkyl group, a sulfoalkyl group, a carboxyalkyl group, an aminoalkyl group, a condensed carbon ring or a heterocyclic color ring. Further, they may be in either configuration of symmetry and asymmetry. Still further, they are also allowed to have an alkyl group, a phenyl group, an enamine group or a hetero ring substituent on the methin or polymethin ring thereof.

The abovementioned merocyanine dyes are also allowed to have such an acidic nucleus as a thiohydantoin nucleus, a rhodanine nucleus, an oxazolylic acid nucleus, a thiazolinethion nucleus, a malononitrile nucleus and a pyrazolone nucleus. The abovementioned acidic nuclei each may further be substituted by an alkyl group, an alkylene group, a phenyl group, a carboxyalkyl group, a sulfoalkyl group, a hydroxyalkyl group, an alkoxyalkyl group, an alkylamine group or a heterocyclic nucleus. If occasion requires, the aforementioned dyes may combinedly be used thereto. It is further allowed to use thereto jointly with an ascorbic acid derivative, an azaindene cadmium salt, an organic sulfonic acid, and such a supersensitizing additive which does not absorb any visible rays of light as described in U.S. Pat. Nos. 2,933,390 and 2,937,089; and the like.

An amount of the abovementioned dyes to be added is from $1\times10^{-4}$ mole to 1 mole and more preferably from $1\times10^{31\ 4}$ mole to $1\times10^{-1}$ mole per mole of a silver halide or a silver halide forming component to be used.

In the heat developable color light sensitive materials of the invention, a variety of organic silver salts may be used for the purposes of increasing the sensitivity thereof and improving the processability thereof as occasion demands.

The organic silver salts to be used in the heat developable color light sensitive materials of the invention include, for example, the silver salts of an aliphatic carboxylic acid such as those described in Japanese Patent Examined Publication Nos. 4921/1968, 26582/1969, 18416/1970, 12700/1970, and 22185/1970; Japanese Patent O.P.I. Publication Nos. 52626/1974, 31728/1977, 137321/1977, 141222/1977, 36224/1978, 37610/1978 and the like; and U.S. Pat. Nos. 3,330,633, 3,794,496, 4,105,451, 4,123,274, 4,168,980 and the like. e.g., silver laurate, silver myristate, silver palmitate, silver stearate, silver arachidonate, silver behenate, silver α-(1-phenylterazolethio)acetate and the like; an aromatic carboxylic acid silver such as silver benzoate, silver phthalate, and the like; a silver salt of an imino group such as those described in Japanese Patent Examined Publication Nos. 26582/1969, 12700/1970, 18416/1970 and 22185/1970; Japanese Patent O.P.I. Publication Nos. 31728/1977, 137321/1977, 118638/1983, 118639/1983 and the like, e.g., benzotriazole silver, 5-nitrobenzotriazole silver, 5-chlorobenzotriazole silver, 5-methoxybenzotriazole silver, 4-sulfobenzotriazole silver, 4-hydroxybenzotriazole silver, 5-aminobenzotriazole silver, 5-carboxybenzotriazole silver, imidazole silver, benzimidazole silver, 6-nitrobenzimidazole silver, pyrazole silver, urazole silver, 1,2,4-triazole silver, 1H-tetrazole silver, 3-amino-5-benzylthio-1,2,4-triazole silver, silver saccharate, phthalazinone silver, phthalimido silver, and the like; and besides. 2-mercaptobenzoxazole silver, mercaptoxadiazole silver, 2-mercaptobenzothiazole silver, 3-mercapto-4-phenyl-1,2,4-triazole silver, 4-hydroxy-6-methyl-1,3,3a,7-tetrazaindene silver, 5-methyl-7-hydroxy-1,2,3,4,6-pentazaindene silver and the like. Among the abovementioned organic silver salts, the preferred ones are the silver salts of a benzotriazole derivative, and the further preferred ones are the silver salts of a sulfobenzotriazole derivative.

The organic silver salts capable of being used in the invention may be used independently or in combination, and the isolated ones may also be used in the invention after they are dispersed in binders by making use of a suitable means, and in addition, it is further allowed that the abovementioned silver salts prepared in a suitable binder are used in the invention as they are without being isolated.

The abovementioned organic silver halides are to be used in an amount of from 0.01 mole to 500 mole and, more preferably, from 0.1 mole to 100 mole each per mole of a light sensitive silver halide to be used.

The reducing agents capable of being used in the heat developable color light sensitive materials of the invention may be those being popularly used in the field of heat developable color light sensitive materials. They include, for example, a p-phenylenediamine or p-aminophenol type developing agent, a phosphoramidophenol or sulfonamidophenol type developing agent and a hydrazone type color developing agent, those of which are described in, for example. U.S. Pat. Nos. 3,531,286, 3,761,270 and 3,764,328; Research Disclosure Nos. 12146, 15108 and 15127; Japanese Patent O.P.I. Publication No. 27132/1981; and the like. Besides the above, the color developing agent precursors described in, for example, U.S. Pat. Nos. 3,342,599 and 3,719,492; Japanese Patent O.P.I. Publication Nos. 135628/1978 and 79035/1979; and the like, may also advantageously be used.

The particularly preferable reducing agents include, for example, those represented by the following Formula (19) of which Japanese Patent O.P.I. Publication No. 146133/1981 describes:

Formula (19):

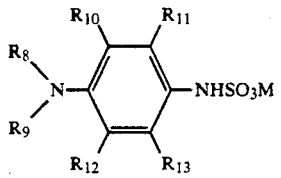

wherein, $R_8$ and $R_9$ each represent hydrogen or an alkyl group having 1 to 30 and preferably 1 to 4 carbon atoms, which may have a substituent; and $R_8$ and $R_9$ are allowed to close the ring so as to form a heterocyclic ring: $R_{10}$, $R_{11}$, $R_{12}$ and $R_{13}$ each represent hydrogen, a halogen, a hydroxy group, an amino group, an alkoxy group, an acylamide group, a sulfonamide group, an alkylsulfonamide group or an alkyl group having 1 to 30 carbon atoms and more preferably 1 to 4 carbon atoms, which is allowed to have a substituent; and $R_{10}$ and $R_8$, and $R_{12}$ and $R_9$ may be close the rings so as to form a heterocyclic rings, respectively: and M represents an alkali metal atom, ammonium group, a nitrogen-containing organic base or a compound containing a quaternary nitrogen atom.

In the Formula (19), a nitrogen-containing organic base means a basicity indicating organic compound containing nitrogen atoms which is capable of producing both of an inorganic acid and a salt. The particularly important organic bases include, for example, an amine compound. A chain amine compound include, for example, a primary amine, a secondary amine, a tertiary amine and the like; and a ring amine compound include, for example, pyridine, quinoline, piperidine, imidazole and the like which are the famous examples of the typical heterocyclic organic bases. Besides the above, such a compound as hydroxylamine, hydrazine, amidine or the like is also useful for the chain amines. The salts of the nitrogen-containing organic bases which are preferably used include, for example, the inorganic acid salts of such an organic base as described the above, e.g., a hydrochloride, a sulfate, a nitrate and the like.

On the other hand, in the abovementioned Formula, the compounds each containing quaternary nitrogen include, for example, the salts of a tetravalent nitrogen compound having a covalent bond, a hydroxide, or the like.

The reducing agents represented by the Formula (19) may be synthesized in such a well-known process as described, in, for example, Houben-Weyl, 'Methoden der Organischen Chemie'. Band XI/2. pp. 645–703.

Besides the above, such a reducing agent as given below may also be used:

They include, for example, a phenol such as p-phenylphenol, p-methoxyphenol, 2,6-di-tert-butyl-p-cresol, N-methyl-p-aminophenol, and the like; a sulfonamidophenol such as 4-benzenesulfonamidophenol, 2-benzenesulfonamidophenol, 2,6-dichloro-4-benzenesulfonamidophenol, 2,6-dibromo-4-(p-toluene sulfonamide)phenol and the like; a polyhydroxybenzene such as hydroquinone, tert-butylhydroquinone, 2,6-dimethylhydroquinone, chrolohydroquinone, carboxyhydroquinone, catechol, 3-carboxy catechol and the like; a naphthol such as α-naphthol, β-naphthol, 4-aminonaphthol, 4-methoxynaphthol and the like; a hydroxybinaphthyl and a methylenebisnaphthol such as 1,1'-dihydroxy-2,2'-binaphthyl, 6,6'-dibromo-2,2'-dihydroxy-1,1'-binaphthyl, 6,6-dinitro-2,2'-dihydroxy-1,1'-binaphthyl, 4,4'-dimethoxy-1,1'-2,2'-binaphthyl, bis(2-hydroxy-1-naphthyl)methane, and the like; a methylenebisphenol such as 1,1-bis-(2-hydroxy-3,5-dimethylphenyl)-3,5,5-trimethylhexane, 1,1-bis(2-hydroxy-3-tert-butyl-5-methylphenyl)methane, 1,1-bis (2-hydroxy-3,5-di-tert-butylphenyl)methane, 2,6-methylenebis-( 2-hydroxy-3-tert-butyl-5-methylphenyl)-4-methylphenol, α-phenyl-α,α-bis(2-hydroxy-3,5-di-tert-butylphenyl)methane, α-phenyl-α,α-bis(2-hydroxy-3-tert-butyl-5-methylphenyl)methane, 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis-(4-hydroxy-3-methyl-5-tert-butylphenyl)propane, 2,2-bis-(4-hydroxy-3,5-di-tert-butyl phenyl)propane and the like; an ascorbic acid; a 3-pyrazolidone; a pyrazolone; a hydrazone; and a paraphenylenediamine.

The abovementioned reducing agents may be used independently or in combination. An amount of the reducing agents to be used depend upon the kinds of light sensitive silver halides, silver salts of organic acids, other additives and the like which are to be used. However, the reducing agents are normally used in an amount of from 0.01 mole to 1500 mole and more preferably from 0.1 mole to 200 mole, per mole of a light sensitive silver halide to be used.

The binders to be used in the heat developable color light sensitive materials of the invention include, for example, a synthetic or natural macromolecular substance such as polyvinyl butyral, polyvinyl acetate, ethyl cellulose, polymethyl methacrylate, cellulose acetate butylate, polyvinyl alcohol, polyvinyl pyrrolidone, gelatin, phthalic gelatin and the like, which may be used independently or in combination. It is particularly preferred to jointly use gelatin or the derivatives and a hydrophilic polymer such as polyvinyl pyrrolidone, polyvinyl alcohol or the like. A still further preferable binder is the following one which is described in Japanese Patent Application No. 104249/1983.

The binder described therein contains gelatin and a vinyl pyrrolidone polymer. Such vinyl pyrrolidone polymers may be a vinyl pyrrolidone which is a monopolymer of vinyl pyrrolidone, and may also be a copolymer (including a graft copolymer) of vinyl pyrrolidone and one or not less than two other monomers capable of copolymerizing. These polymers may be used without regard to the polymerization degrees thereof. The polyvinyl pyrrolidone may be a substituted polyvinyl pyrrolidone, and the more preferable polyvinyl pyrrolidone is of from 1,000 to 400,000 in molecular weight. The other monomers capable of copolymerizing vinyl pyrrolidone include, for example, acrylic acid; methacrylic acid; such a (metha)acrylic acid ester as the alkyl esters of the abovementioned acrylic acid or methacrylic acid; a vinyl alcohol; a vinyl imidazol; a (metha)acrylamide; a vinyl carbinol; such a vinyl monomer as a vinyl alkylether; and the like. It is preferable that a vinyl pyrrolidone content in the composition thereof is at least 20% (hereinafter referred to as a % by weight). In the preferable examples of such copolymers as described above, the molecular weight thereof is from 5,000 to 400,000.

Gelatins to be used may be those processed with either lime or an acid, and they may also be osein gelatin, pig-skin gelatin, a hide gelatin or the modified gelatins in which the abovementioned gelatins are esterified, or phenylcarbamoylated and the like.

In the abovementioned binders, the proportion of a gelatin content to a total amount of all the binders is preferably from 10% to 90% and more preferably from 20% to 60%; and that of vinyl pyrrolidone thereto is preferably from 5% to 90% and more preferably from 10% to 80%.

The abovementioned binders are also allowed to contain the other macromolecular substances than the above, such as, preferably, a mixture of gelatin, a polyvinyl pyrrolidone of from 1,000 to 400,000 in molecular weight and one or more other macromolecular substances, or a mixture of gelatin, a vinyl pyrrolidone copolymer of from 5,000 to 400,000 in molecular weight and one or more other macromolecular substances. Such other macromolecular substances as are used therein include, for example, polyvinyl alcohol, polyacrylamide, polymethacrylamide, polyvinyl butyral, polyethylene glycol, a polyethylene glycol ester, a protein such as a cellulose derivative, and a natural substance such as a polysaccharide including starch, gum arabic and the like. These substances may be added in an amount of from 0 to 85% and more preferably from 0 to 70%. The abovementioned vinyl pyrrolidone polymers may also be a coupled polymer, and in this case, however, it is preferred that they are to be coupled after coating them on a support. This includes the case that such coupling reaction is to be progressed by allowing them to stand.

An amount of the binders to be normally used is from 0.05 g to 50 g and preferably from 0.1 g to 10 g, per sq. meter of a layer. Such binders are used in an amount of preferably from 0.1 g to 10 g and more preferably from 0.25 g to 4 g. per gram of the monomer unit of a dye providing substance to be used.

The supports which may be used in the heat developable color photosensitive materials of the invention include, for example, a polyethylene film; a cellulose acetate film; a synthesized plastic film such as that made of polyvinyl chloride or the like; a paper support such as a base paper for photographic use, a paper for printing use, a baryta paper, a resin coated paper and the like; a support made of the abovementioned synthesized plastic film bearing thereon a reflective layer; and the like.

In particular, the heat developable color photosensitive materials of the invention may preferably be added with a variety of heat solvents. The heat solvents relating to the invention are allowed to use, provided that they are substances capable of accelerating a heat development and/or a heat transfer. They are preferably a solid, a semi-solid or a liquid at an ordinary temperature, that is, their boiling point is preferably not lower than 100° C. and more preferably not lower than 150° C. at an ordinary pressure so as to be dissolved or fused in binders by heating them. The preferable examples thereof include, a urea derivative such as dimethyl urea, diethyl urea, phenyl urea and the like; an amide derivative such as acetamide, benzamide and the like; a polyhydric alcohol such as 1,5-pentanediol, 1,6-pentanediol, 1,2-cyclohexanediol, pentaerythritol, trimethylolethane and the like; and a polyethylene glycol. The more concrete examples thereof are given in Japanese Patent Application No. 104249/1983. The abovementioned heat solvents are allowed to use independently or in combination.

The heat developable color photosensitive materials of the invention may be added with, if occasion demands, a variety of additives, besides the abovementioned components. Among them, for example, development accelerators include an alkali releasing agent such as urea, guanidium trichloroacetate and the like described in U.S. Pat. Nos. 3,220,840, 3,531,285, 4,012,260, 4,060,420, 4,088,496, and 4,207,392, Research Disclosure Nos. 16733, 15734 and 15776, Japanese Patent O.P.I. Publication Nos 130745/1981 and 132332/1981, and the like; the organic acids described in Japanese Patent Examined Publication No. 12700/1970; the nonaqueous polar solvent compounds each having a —CO—, —$SO_2$— or —SO— group described in U.S. Pat. No. 3,667,959; the melt-formers described in U.S. Pat. No. 3,438,776; the polyalkylene glycols described in U.S. Pat. No. 3,666,477 and Japanese Patent O.P.I. Publication No. 19525/1976: and the like. A color toning agent includes such a compound as phthalazinone, phthalimide, pyrazolone, quinazolinone, N-hydroxynaphthalimide, benzoxazine, naphthoxazinedione, 2,3-dihydro-phthalazinedione, 2,3-dihydro-1,3-oxazine-2,4-dione, oxypyridine, aminopyridine, hydroxyquinoline, aminoquinoline, isocarbostyryl, sulfonamide, 2H-1,3-benzothiazine-2,4-(3H)dione, benzotriazine, mercaptotriazine, mercaptotriazole, dimercaptotetrazapentalene, phthalic acid, naphthalic acid, phthalamic acid and the like, each described in, for example, Japanese Patent O.P.I. Publication Nos. 4928/1971, 6077/1971, 5019/1974, 5020/1974, 91215/1974, 107727/1974, 2524/197517 , 67132/1975, 67641/1975, 114217/1975, 33722/1977, 99813/1977, 1020/1978, 55115/1978, 76020/1978, 125014/1978, 156523/1979, 156524/1979, 156525/1979, 16526/1979, 4060/1980, 4061/1980, 32015/1980 and the like; West German Patent Nos. 2,140,406, 2,147,063, and 2,220,618; U.S. Pat. Nos. 3,080,254, 3,847,612, 3,782,941, 3,994,732, 4,123,282, 4,201,582 and the like. Further, a mixture of one or more of the abovementioned compounds and an imidazole compound; a mixture of at least one of such an acid as phthalic acid, naphthalic acid or the anhydrides thereof and a phthalazine compound; a combination of phthalazine with maleic acid, itaconic acid, quinolinic acid, gentisic acid or the like; and the like.

It is also effective for the abovementioned purpose to use a 3-amino-5-mercapto-1,2,4-triazole, and a 3-acylamino-5-mercapto-1,2,4-triazole which are described in Japanese Patent O.P.I. Publication Nos. 189628/1983 and 193460/1983.

The compounds capable of serving as an antifoggant include, for example, a mercuric salt; an oxidizing agent such as a N-halogenacetamide, a N-halogenosuccinic acid amide, perchloric acid and the salts thereof, an inorganic peroxide, a persulfate, and the like; an acid and the salts thereof such as sulfinic acid, lauric acid, lithium, rosin, diterpenic acid, thiosulfonic acid and the like; a sulfur-containing compound such as a mercapto-compound releasable compound, thiouracil, disulfide, a simple substance of sulfur, mercapto-1,2,4-triazole, thiazolinthione, a polysulfide compound and the like; and, besides the above, such a compound as oxazoline, 1,2,4-triazole, phthalimide and the like, each described in, for example, Japanese Patent Examined Publication No. 11113/1972; Japanese Patent O.P.I. Publication Nos. 90118/1974, 10724/1974, 97613/1974, 101019/1975, 130720/1974, 123331/1975, 47419/1976, 57435/1976, 78227/1976, 104338/1976, 104338/1976, 19825/1978, 20923/1978, 50725/1976, 3223/1976, 42529/1976, 81124/1976, 51821/1979 and 93149/1980; British Patent No. 1,455,271; U.S. Pat. Nos. 3,885,968, 3,700,457, 4,137,079, and 4,138,265; West German Patent No. 2,617,907; and the like. The compounds capable of usefully serving as the other antifoggants include, for example, a thiol compound out of which a thiophenol compound is more preferable to use.

A further antifoggant capable of being preferably used includes, for example, a hydroquinone derivative such as di-t-octylhydroquinone, dodecanylhydroquinone and the like each described in Japanese Patent Application No. 56506/1984: and a joint use of a hydroquinone derivative and a benzotriazole derivative such as 4-sulfobenzotriazole, 5-carboxybenzotriazole and the like described in Japanese Patent Application No. 66380/1984.

A printout preventing agent for post-processing use may also be used in particular to serve as a stabilizer at the same time. For example, a hydrocarbon halide described in Japanese Patent O.P.I. Publication Nos. 45228/1973, 119624/1975, 120328/1975, 46020/1978 and the like. They typically include tetrabromobutane, tribromoethanol, 2-bromo-2-tolylacetamide, 2-bromo-2-tolylsulfonylacetamide, 2-tribromomethylsulfonyl benzothiazole, 2,4-bis(tribromomethyl)-6-methyltriazine and the like.

A post-processing may also be treated with a sulfur-containing compound, as described in Japanese Patent Examined Publication No. 5393/1971 and Japanese Patent O.P.I. Publication Nos. 54329/1975 and 77034/1975.

In addition, they are also allowed to contain an isothiuronium stabilizer precursor described in U.S. Pat. Nos. 3,301,678, 3,506,444, 3,824,103 and 3,844,788; an activator stabilizer precursor described in U.S. Pat. Nos. 3,669,670, 4,012,260 and 4,060,420; and the like.

It is also allowed to use such a water-releasing agent as cane sugar, $NH_4Fe(SO_4)_2.12H_2O$ or the like. Still further, a heat development may also be carried out by supplying water as described in Japanese Patent O.P.I. Publication No. 132332/1981.

The heat developable color photosensitive materials of the invention may if necessary be added with a variety of additives, coating aids and the like such as a spectrally sensitizing dye, an antihalation dye, an optically brightening agent, a hardener, an antistatic agent, a plasticizer, a spreading agent and the like, besides the aforementioned components.

In the heat developable color photosensitive materials of the invention, one and the same layer thereof basically contains 1. a photosensitive silver halide; 2. a reducing agent; 3. a dye-providing substance; and 4. a binder; and more preferably. 5. an organic silver salt if occasion demands.

It is not always necessary to contain the abovementioned components 1 through 5 in a single photosensitive layer, but it is allowed to contain them separately in two or more photosensitive layers, provided that the components are in such a state that they are able to react each other in such a manner, for example, that a photosensitive layer having a certain color sensitivity is divided into two layers and the components 1, 2, 4 and 5 are contained in one of the photosensitive layers and the component 3 is contained in the other layer adjacent to the former photosensitive layer; or in the like manner.

Also, a photosensitive layer having a certain color sensitivity may be provided by dividing into two or more layers such as a high speed photosensitive layer and a low speed photosensitive layer, and further, the photosensitive layer may be provided with a variety of photographic component layers such as an over-coating layer, an under-coating layer, a backing layer and the like.

Similar to the case of preparing the heat developable photosensitive layers of the invention, the coating liquids for the other photographic component layers such as a protective layer, an under-coating layer, a backing layer and the like are prepared so as to produce a photosensitive material in a variety of coating processes such as an impregnation coating method, an air-knife coating method, a curtain-coating method, such a hopper-coating method as described in U.S. Pat. No. 3,681,294, and the like methods.

If a further occasion demands, two or more layers may be prepared at the sam time by coating in such a method as described in U.S. Pat. No. 2,761,791 and British Patent No. 837,095.

The abovementioned components to be used in the heat developable color photosensitive materials of the invention are to be coated on the supports thereof, respectively. The dried coating thickness thereof is preferably from 1 to 1,000 μm and more preferably from 3 to 20 μm.

The heat developable color photosensitive materials of the invention can be color developed in such a manner that they are exposed imagewise to light and are then only heated at a temperature within the range of ordinarily from 80° C. to 200° C. and more preferably from 120° C. to 170° C. for a period of time of from 1 second to 180 seconds and more preferably from 1½ seconds to 120 seconds. If occasion demands, they may be developed by bringing a water impervious material into contact therewith, or by heating them in advance at a temperature within the range of from 70° C. to 180° C. before exposing them to light.

The heat developable color photosensitive materials of the invention may be applied with a variety of exposure means. A latent image may be obtained by imagewise exposing to radiation rays of light including visible rays of light. In general, the light sources capable of being used for the abovementioned purpose include, for example, an ordinary light source for color printing use such as a tungsten lamp, a mercury lamp, a xenon lamp, a laser beam, a cathode-ray tube light and the like.

Any heating means may be used therefor, provided that they may be applied to ordinary heat developable photosensitive materials. For example, there is given such a means that a heated block or plate is brought into contact with a heat developable photosensitive material; a heat-roller or heat-drum is brought into contact therewith; a photosensitive material is passed through a high temperature atmosphere; a high frequency heating treatment is applied thereto; or a conductive layer is provided into a photosensitive material or heat-transfer image receiving layer of the invention so as to utilize Joule heat generated by an electrification or a ferromagnetic field therein. Heating patterns are not particularly limited, but a simple pattern is preferred, and a simultaneously exposing and heating system is also applicable, though it is also allowed to use such a method that a heating is made at a relatively high temperature for a short time or at a relatively low temperature for a long time with raising or lowering the temperature continuously or with repeating the temperature up and down, or the heating is made intermittently. And, it is possible as well to use such a method that a preheating is made in advance and a further heating is made again.

An image receiving member may be used provided that it is capable of receiving the dyes released or formed by a heat development, and it is preferred that it is prepared of a mordant which is to be used in dye dispersion-transfer type photosensitive materials and a heat-resisting organic macromolecular substance having a glass transition temperature of not lower than 40° C. and not higher than 250° C., that is described in Japanese Patent O.P.I. Publication No. 207250/1982.

The typical examples of the abovementioned mordants include a nitrogen-containing secondary or tertiary amine; a nitrogen-containing heterocyclic compound; the quaternary cationic compounds thereof; a vinylpyridine polymer and a vinylpyridinium cationic polymer each disclosed in U.S. Pat. Nos. 2,548,564, 2,484,430, 3,148,061, and 3,756,814; a polymer containing dialkylamino group disclosed in U.S. Pat. No. 2,675,316; an aminoguanidine derivative disclosed in U.S. Pat. No. 2,882,156; a covalent bonding reactive polymer described in Japanese Patent O.P.I. Publication No. 37333/1979; a mordant capable of coupling to gelatin or the like disclosed in U.S. Pat. Nos. 3,625,694 and 3,859,096 and British Patent Nos. 1,277,453 and 2,011,012; an aqueous sol type mordant disclosed in U.S. Pat. Nos. 3,958,995, 2,721,852 and 2,798,063; a water-insoluble mordant disclosed in Japanese Patent O.P.I. Publication No. 61228/1975; and the various mordants disclosed in U.S. Pat. No. 3,788,855, West German OLS Patent No. 2,843,320, Japanese Patent O.P.I. Publication Nos. 30328/1978, 155528/1977, 125/1978, 1024/1978, 74430/1979, 124726/1979 and 22766/1980, U.S. Pat. Nos. 3,642,482, 3,488,706, 3,557,066, 3,,271,147 and 3,271,148, Japanese Patent Examined publication Nos. 29418/1980, 36414/1981 and 12139/1982, and Research Disclosure No. 12045 (1974).

The particularly useful mordants are polymers each containing an ammonium salt, that is, polymers each containing quaternary amino group described in U.S. Pat. No. 3,709,690. Such a polymer containing an ammonium salt includes, for example, a polystyrene-co-N,N,N-tri-n-hexyl-N-vinylbenzyl-ammonium chloride in which the proportion of the styrene to the vinyl benzylammonium chloride is from 1:4 to 4:1 and preferably 1:1.

A typical image-receiving layer for dye dispersion and transfer use may be prepared by coating a mixture of polymers each containing an ammonium salt and gelatin onto a support.

The abovementioned heat-resisting organic macromolecular substances include, for example, a polystyrene having a molecular weight of from 2,000 to 85,000, a polystyrene derivative having a substituent having not more than 4 carbon atoms, polyvinyl cyclohexane, polyvinyl benzene, polyvinyl pyrrolidone, polyvinyl carbazole, polyallyl benzene, polyvinyl alcohol, polyvinyl formal, polyvinyl butyral and the like, which are polyacetals; polyvinyl chloride, chlorinated polyethylene, polyethylene trichlorofluoride, polyacrylonitrile, poly-N,N-dimethylacrylamide, a polyacrylate having a p-cyanophenyl group, pentachlorophenyl group and 2,4-dichlorophenyl group, polyacryl chloroacrylate, polymethyl methacrylate, polyethyl methacrylate, polypropyl methacrylate, polyisopropyl methacrylate, polyisobutyl methacrylate, poly-tert-butyl methacrylate, polycyclohexyl methacrylate, polyethyleneglycol dimethacrylate, poly-2-cyano-ethyl methacrylate, polyethyleneterephthalate and the like which are polyesters; polysulfone, bisphenol A polycarbonate and the like which are polycarbonates; polyanhydrides; polyamides; cellulose acetates; and the like. In addition to the above, synthetic polymers each having a glass transition temperature of not lower than 40° C. described in J. Brundrup and E. H. Immergut. 'Polymer Handbook', 2nd Ed., John Wiley and Sons, are also useful. The abovementioned macromolecular substances may be used independently or in combination in the form of a copolymer.

The particularly useful polymers include, for example, a cellulose acetate such as triacetate, diacetate and the like; a polyamide prepared in combination of heptamethylenediamine and terephthalic acid, fluorenedipropylamine and azipic acid, hexamethylenediamine and diphenic acid, hexamethylenediamine and isophthalic acid, and the like; a polyester prepared in combination of diethyleneglycol and diphenylcarboxylic acid, bis-p-carboxyphenoxybutane and ethyleneglycol, and the like; polyethleneterephthalate; polycarbonate; vinyl chloride. The abovementioned polymers may be modified. For example, it is also effective to use a polyethyleneterephthalate modified with cyclohexane dimethanol, isophthalic acid, methoxypolyethyleneglycol, 1,2-dicarbomethoxy-4-benzenesulfonic acid or the like served as a modifying agent. Among the abovementioned image receiving layers, the particularly preferable ones include, for example, a layer comprising polyvinyl chloride described in Japanese Patent Application No. 97907/1983, and a layer comprising polycarbonate and a plasticizer described in Japanese Patent Application No. 128600/1983.

The abovementioned polymers are dissolved in a suitable solvent and are then coated on a support so as to be able to make an image receiving layer, or a film-like image receiving layer comprising the abovementioned polymers is laminated on a support so as to be used in a photosensitive material. Further, an image receiving layer may be made of a member (such as a sheet of film) comprising the abovementioned polymers solely, that is a combination image receiving layer and support type.

Such an image receiving layer may also be made by providing an opaque layer, i.e., a reflective layer, containing titanium or the like dispersed in gelatin onto a transparent support. On the opaque layer, a reflection type color image may be obtained when a transferred color image is seen from the transparent support side of the image receiving layer.

[Advantages of the Invention]

As is obvious from the above description, in the heat developable color photosensitive materials of the invention, the transferability of dyes are excellent and a minimum density, i.e., a fogginess, does not increase derivatively, so that substantially high maximum density images can satisfactorily be obtained.

[EXAMPLE]

The invention will now be described in further detail with reference to the following examples. It is, however, to be understood that the invention shall not be limited thereto,

EXAMPLE-1

An organic silver salt dispersion liquid was prepared in such a manner that 4-sulfobenzotriazole and silver nitrate were reacted together in water so as to obtain 4-sulfobenzotriazole silver, and 50 g thereof, 20 g of polyvinyl pyrolidone and 60 ml of water were dispersed by making use of a alumina ball mill.

The following dye providing substance (1) in an amount of 470 mg was dissolved in 2.1 cc of ethyl acetate. The resulted solution was mixed in 3 cc of a 2.5% gelatin solution containing a surface active agent. The resulted mixture was added with water to make 6.5 cc and was then decomposed by making use of a homogenizer, so that the dispersion liquid of the dye providing substance.

Next, 6.5 cc of the resulted dye providing substance dispersion solution and 20 cc of the resulted organic silver salt dispersion were mixed in 3.5 cc of water containing 250 mg of polyvinyl pyrrolidone of 30,000 in average molecular weight and 500 mg of polyethylene glycol of 300 in average molecular weight, and 200 mg of the following reducing agent was added thereto. After then, the pH value thereof was adjusted to 5.5 by making use of 3% citric acid. The resulted dispersion solution was added with a green-sensitive silver iodobromide emulsion having an average grain size of 0.1$\mu$ in an amount of $1\times10^{-3}$ mole in terms of silver (The emulsion contained 85 mg of gelatin), and water was added thereto to make 15 scc. After then, the resulted matter was coated on a polyethyleneterephthalate support by making use of a wire-bar to be in dried thickness of 8$\mu$, so that the first photosensitive layer was provided.

Next, an interlayer was provided onto the abovementioned first photosensitive layer in such a manner that 0.2 g of gelatin, 0.8 g of polyvinyl pyrrolidone and 0.8 g of polyethylene glycol having an average molecular weight of 300 were dissolved in 10 ml of water, and the resulted solution was coated on the abovementioned first photosensitive layer by making use of a wire-bar so as to be 20$\mu$ in wet thickness.

Then, the second photosensitive layer was provided on the abovementioned interlayer in such a manner that a coating solution having the same composition as that used in the abovementioned first photosensitive layer was prepared except that the dye providing substance (1) was replaced by 470 mg of the following dye providing substance (2) and the silver halide was replaced by a red-sensitive silver iodobromide emulsion having an average grain size of 0.1$\mu$, and the resulted coating solution was coated in the same manner as in the first photosensitive layer. The resulted photosensitive element was referred to as Sample-1.

Next, Sample-2 provided with the same interlayer as that of Sample-1 was prepared in the same manner as in Sample-1, except that the same interlayer was added therein with 0.3 g of titanium dioxide (RN-43 manufactured by Chronos Co.) having an average particle size of 0.25$\mu$. and Sample-3 was prepared by making use of carbon black (#30 manufactured by Mitsubishi Chemical Industry Co.) in place of titanium dioxide used in Sample-2, and further Sample-4 was prepared by making use of zinc oxide, respectively.

Then, a sheet of image receiving paper prepared by coating vinyl chloride on a sheet of baryta paper was superposed on the coated surface of each sample already exposed to light, and the resulted samples with the image receiving papers were brought into contact with and heated by a metal-made heating block having the surface temperature of 150° C. for 10 seconds. The image receiving papers were peeled off and the density of a dye image transferred to each of the image receiving paper was measured by making use of green light and red light. The results thereof are shown in Table-1.

Dye Providing Substance (1)

-continued

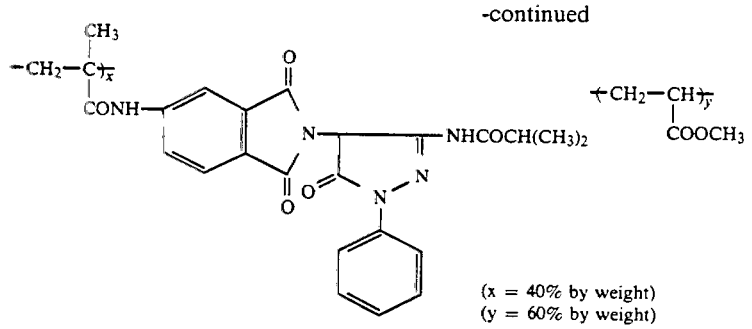

(x = 40% by weight)
(y = 60% by weight)

Dye Providing Substance (2)

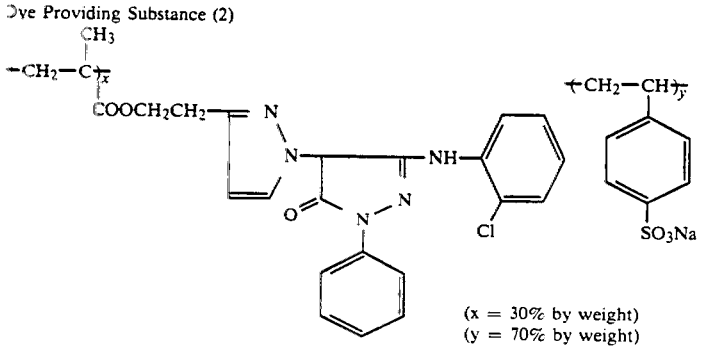

(x = 30% by weight)
(y = 70% by weight)

Reducing Agent

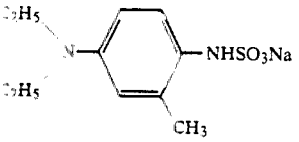

As is obvious from Table-1, it is understood that the samples (Sample-2 through Sample-4) of the invention each provided with the interlayers containing solid grains were substantially improved on the transferability of dyes diffusible from the lower layer, and the maximum density (Dmax) thereof was substantially high, as compared with the comparative sample (Sample-1).

TABLE 1

| | | Green Exp. | |
|---|---|---|---|
| | | Red | Green |
| Sample-1 | Dmax | 0.32 | 1.47 |
| (Comparative) | Dmin | 0.24 | 0.31 |
| Sample-2 | Dmax | 0.31 | 1.70 |
| (Invention) | Dmin | 0.23 | 0.31 |
| Sample-3 | Dmax | 0.30 | 1.73 |
| (Invention) | Dmin | 0.24 | 0.30 |
| Sample-4 | Dmax | 0.32 | 1.64 |
| (Invention) | Dmin | 0.24 | 0.29 |

EXAMPLE-2

Sample-2 through Sample-8 were prepared in such a manner that an interlayer (the second interlayer), a blue photosensitive layer (the third photosensitive layer) and a protective layer were coated in order on Sample-1 through Sample-4 of Example-1, respectively.

The abovementioned second interlayers were added with the same amount of the same solid particles as those added in the interlayers of Example-1 (hereinafter called the first interlayers). (See Table-2)

TABLE 2

| Sample No. | Substrate | Solid Particle of 1st/2nd Interlayer |
|---|---|---|
| 5 | Sample-1 | None |
| 6 | Sample-2 | Titanium oxide |
| 7 | Sample-3 | Carbon black |
| 8 | Sample-4 | Zinc oxide |

The 2nd interlayer . . . The following polymer Y filter dye in the amount of 400 mg was dissolved in 1.2 cc of ethyl acetate, and the resulted solution was mixed in 2.0 cc of a 2.5% gelatin solution containing a surface active agent. The resulted mixture was dispersed by a homogenizer and water was added thereto to make 3.5 cc, so that a polymer Y filter dye dispersion solution was prepared.

Polymer Y Filter Dye:

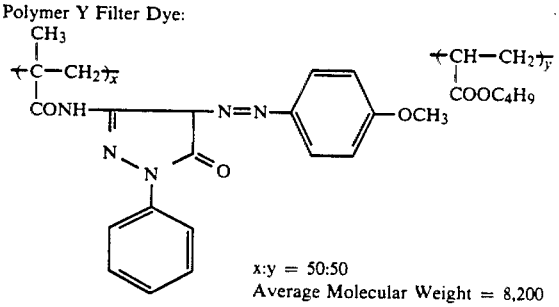

x:y = 50:50
Average Molecular Weight = 8,200

The abovementioned dispersion solution in the amount of 3.5 cc was mixed in 1.6 g of polyvinyl pyrrolidone, 1.6 g of polyethylene glycol of which average molecular weight was 300 and 16.5 cc of an aqueous solution containing 0.6 g of the aforementioned solid particles. The resulted solution was then coated on the Sample-1 through Sample-4 of Example-1 by making use of a wire-bar, respectively, as shown in Table-2, so that the wet thickness thereof could be 20μ.

The 3rd Photosensitive . . . This layer was coated in the same manner as in preparing the 1st photosensitive layer of Example-1, except that 470 mg of the following dye providing substance (3) and a blue sensitive silver iodobromide emulsion having an average grain size of 0.1μ were used in place of the dye providing substance (1) and the silver halide, respectively.

Dye Providing Substance (3)

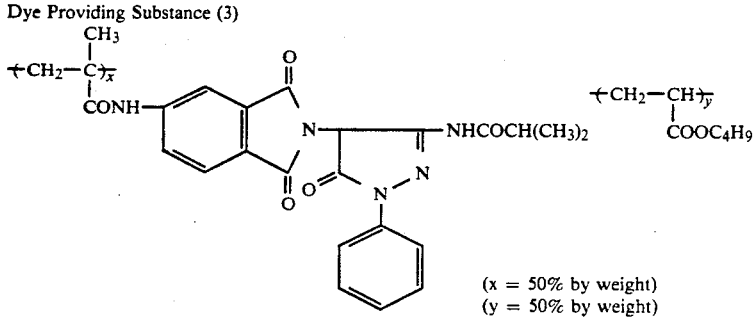

(x = 50% by weight)
(y = 50% by weight)

Protective Layer . . . This layer was provided by coating a liquid having the same composition as that of the interlayer of Sample-1 of Example-1 on the above-mentioned 3rd photosensitive layer by making use of a wire-bar, so that the wet thickness thereof could be 15μ.

After the resulted photosensitive elements (Sample-5 through Sample-8) were dried up, they were exposed to white light of 1600 CMS, through a step-wedge, respectively.

Next, they were developed by heating in the same manner as in Example-1, so that the transferred images were obtained. The density of each image was measured with blue-light, green-light and red-light, respectively. The results thereof are shown in Table-3 below:

TABLE 3

| Sample No. | | Measurement in Green-light |
|---|---|---|
| 5 | Dmax | 1.23 |
| (Comparative) | Dmin | 0.30 |
| 6 | Dmax | 1.71 |
| (Invention) | Dmin | 0.28 |
| 7 | Dmax | 1.72 |
| (Invention) | Dmin | 0.29 |
| 8 | Dmax | 1.65 |
| (Invention) | Dmin | 0.29 |

As is obvious from the Table-3, it is understood that the samples of the invention (Sample-6 through Sample-8) each having the interlayer containing the solid particles are substantially improved on the transferability of the diffusible dyes from the lower layers, i.e., a red sensitive layer and a green sensitive layer, and each of the maximum density thereof is substantially high, as compared with the comparative sample, i.e., sample-5.

What is claimed is:

1. A heat developable color photosensitive material comprising
   - a support having thereon at least tow photosensitive layers which contain at least
   - a photosensitive silver halide,
   - a dye-providing substance capable of releasing or forming a diffusible dye in a heat development,
   - a reducing agent and
   - a binder, wherein each photosensitive layer is different from the other in color sensitivity of said photosensitive silver halide and an interlayer containing a binder including gelatin and a water soluble polymer, and particles wherein said particles have an average particle size of 0.1 to 0.5 μm, are present in an amount of 5 to 100 percent by weight of the binder in the interlayer, and are in the solid state at a temperature in a heat development and wherein said interlayer has a thickness of 0.01 to 20 μm and is interposed between said at least two photosensitive layer.

2. The heat developable color photosensitive material as claimed in claim 1, wherein said particles are at least one selected from the group consisting of organic coloring pigments, inorganic coloring pigments, polymer particles and metal powders.

3. The heat developable color photosensitive material as claimed in claim 2, wherein said particles are at least one selected from the group consisting of titanium dioxide, zinc oxide, calcium oxide, calcium carbonate, magnesium carbonate, barium sulfate, ammonium oxide, silica dioxide, carbon black, ferrite, aluminum, copper, and graphite.

4. The heat developable color photosensitive material as claimed in claim 2, wherein said particles are at least one selected from the group consisting of titanium dioxide and carbon black.

5. The heat developable color photosensitive material as claimed in claim 2, wherein the softening point of said polymer particles is not lower than 150° C.

6. The heat developable color photosensitive material as claimed in claim 1, wherein each of said layers contain said dye providing substance in an amount of from 0.005 to 50 g per sq. meter thereof.

* * * * *

UNITED STATES PATENT AND TRADEMARK OFFICE

CERTIFICATE OF CORRECTION

PATENT NO. : 5,071,740

DATED : December 10, 1991

INVENTOR(S) : Ken OKAUCHI et al.

It is certified that error appears in the above-identified patent and that said Letters Patent is hereby corrected as shown below:

On the title page, Item [63]

related U.S. application data, change "842,261" to --824,261--.

Column 1, line 8, change "06/842,261" to --06/824,261--.

Claim 1, column 34, line 4, change "tow" to --two--.

Claim 1, column 34, line 36, change "layer" to --layers--.

Signed and Sealed this

Twenty-second Day of June, 1993

*Attest:*

Michael K. Kirk

MICHAEL K. KIRK

*Attesting Officer*

*Acting Commissioner of Patents and Trademarks*